US006550708B2

(12) United States Patent
Messier

(10) Patent No.: US 6,550,708 B2
(45) Date of Patent: Apr. 22, 2003

(54) DEVICE FOR A WOUND WIRE THAT IS RELATIVELY STIFF

(76) Inventor: Normand Messier, 105 Principale, East Farnham, Québec (CA), J2K 4T8

( * ) Notice: Subject to any disclaimer, the term of this patent is extended or adjusted under 35 U.S.C. 154(b) by 0 days.

(21) Appl. No.: 09/761,435

(22) Filed: Jan. 16, 2001

(65) Prior Publication Data

US 2001/0008260 A1 Jul. 19, 2001

(30) Foreign Application Priority Data

Jan. 17, 2000 (CA) ..... 2296153

(51) Int. Cl.[7] ..... B65H 49/00; B65H 75/24

(52) U.S. Cl. ..... 242/128; 242/157 R; 242/577.2; 242/577.3; 242/610.5; 242/614.1

(58) Field of Search ..... 242/128, 127, 242/129, 157 R, 570, 577.2, 577.3, 610.5, 614.1

(56) References Cited

U.S. PATENT DOCUMENTS

| | | | | | |
|---|---|---|---|---|---|
| 1,834,159 | A | * | 12/1931 | King, Jr. et al. | 242/128 |
| 1,943,512 | A | * | 1/1934 | Becker | 242/577.3 X |
| 2,286,460 | A | * | 6/1942 | Brown | 242/128 |
| 2,619,665 | A | * | 12/1952 | Hopkins et al. | 242/128 X |
| 3,052,425 | A | * | 9/1962 | Reed et al. | 242/129 X |
| 3,186,659 | A | * | 6/1965 | Arnold | 242/129 X |
| 3,258,221 | A | * | 6/1966 | Derrickson et al. | 242/128 |
| 4,253,624 | A | * | 3/1981 | Colbert | 242/128 |
| 4,471,921 | A | * | 9/1984 | Corbin | 242/129 |
| 4,657,204 | A | * | 4/1987 | Colbert | 242/128 |
| 5,100,077 | A | * | 3/1992 | Gagne et al. | 242/129 |
| 5,348,241 | A | * | 9/1994 | Huette | 242/129 X |
| D409,897 | S | | 5/1999 | Buck | D8/358 |
| 5,931,484 | A | | 8/1999 | Jones et al. | 280/47.24 |
| 5,996,930 | A | | 12/1999 | Katayama et al. | 242/593 |

FOREIGN PATENT DOCUMENTS

| | | |
|---|---|---|
| CA | 2042524 | 4/1995 |

* cited by examiner

*Primary Examiner*—Kathy Matecki
*Assistant Examiner*—Minh-Chau Pham
(74) *Attorney, Agent, or Firm*—Merchant & Gould P.C.

(57) ABSTRACT

A device is provided for a wound wire that is relatively stiff such as electrical wires, cables or similar. According to a first aspect of the invention, the device comprises a shaft; a hub rotatively mounted around the shaft, the hub comprising a central core and a plurality of arms extending radially outwardly therefrom and at least partially around the wound wire for containing the wound wire and restraining an innermost spire thereof; and guides connected to the shaft for guiding the wire extending from the innermost spire as a free end of the spire is being pulled. According to another aspect of the invention, the device comprises a shaft, a body rotatively mounted on the shaft, a hub mounted around the shaft, and guides connected to the body.

15 Claims, 8 Drawing Sheets

DEVICE FOR A WOUND WIRE THAT IS RELATIVELY STIFF

BACKGROUND OF THE INVENTION

1. Field of the Invention

The present invention relates to a device for a wound wire that is relatively stiff such as electrical wires, cables or similar.

2. Brief Description of the Prior Art

It is common practice for shipping and handling purposes to wind wire or cable into spires forming torus shaped coils or rolls. These coils or rolls are later transported and eventually unwounded during installation of the wire by means of wire carts and dispensers such as those described and shown in U.S. Pat. Nos. 5,931,484; 5,996,930 and D409,897.

Coils and rolls of relatively stiff wire such as electrical cable, stay cable and triplex cable, are somewhat different. Since the spires forming these coils or rolls are made of relatively stiff material, they are characterized by a radial outward urge to unwind.

During shipping and handling, the coil of stiff wire is prevented from unwinding by a set of spaced straps disposed and tied around the spires. For the unwinding operation, the coil is positioned inside a unwinding reel such as the one described in Canadian patent No. 2,042,524. The straps are then removed and the spires located at the outer periphery of the coil resiliently abut against the walls of the reel which restrain their radial urge to unwind.

One of the main problems encountered with coil of stiff wire is that, since the coil does not rotate, the wire has a tendency to twist helically on itself as it is being pulled out the reel. The wire being relatively stiff it has a tendency to resiliently untwist. This situation thus creates a potential hazard for the person pulling on the coil as it is being unwounded.

To solve this problem, CA 2,042,524 provides an unwinding reel with a circular shield plate which function is to contain the wire inside the reel and thereby protect the person pulling on the coil as it is being unwounded. Although useful, the unwinding reel of patent CA 2,042,524 is relatively complex and cumbersome. Indeed, a user can not see very well how much wire there is left in the reel. Furthermore, the circular shield plate of CA 2,042,524 must be removed to install a coil of wire which cause a loss of time. The plate also add weight to the reel. The reel described in CA 2,042,524 also comprises a tubular cylindrical member devised to guide and frictionally hold the wire being pulled. However, this cylindrical tubular member has proven not be very functional.

There is thus a need for a lighter, more efficient, simpler to construct and more economical device for unwinding a coil of relatively stiff material, as compared to what is known in the art.

The present invention also fulfils other needs which will be apparent to those skilled in the art upon reading the following specification.

SUMMARY OF THE INVENTION

According to a first aspect of the invention, there is provided a device for a wound wire that is relatively stiff, which comprises:

a shaft;

a hub rotatively mounted around the shaft, the hub comprising a central core and a plurality of arms extending radially outwardly therefrom and at least partially around the wound wire for containing the wound wire and restraining an innermost spire thereof; and guiding means connected to the shaft for guiding the wire extending from the innermost spire as a free end of the spire is being pulled.

Preferably, the device of the invention comprises at least five arms respectively terminated with U-shaped ends. The device may also comprises connecting means for releasably connecting at least some of the arms to the hub.

In another preferred embodiment, the device further comprises mounting means connected to the shaft for fixing the device to a structure.

According to another preferred embodiment, the device of the invention is provided with improved guiding means, the guiding means comprising a body provided with a conical bore having an inlet and an outlet that is smaller than the inlet. The outlet has an internal diameter slightly larger than that of the wire so that the body frictionally engages and holds the wire when it is released. More preferably the body is rigidly connected to the shaft and it is positioned as to be located slightly outside a vertical plane defined by the wound wire with an horizontal angle from about 15° to 45° with the vertical plane.

In yet another preferred embodiment, the hub comprises a circular disk extending radially outwardly from the central core, the arms being connected to the circular disk. More preferably, the circular disk comprises a plurality of solidifying ribs extending radially from the central core for solidifying the disk and rigidly connecting the disk to the central core.

According to a second aspect of the invention, there is provided a device for a wound wire that is relatively stiff, which comprises:

a shaft;

a body rotatively mounted on the shaft;

a hub mounted around the shaft, the hub comprising a central core and a plurality of arms extending radially outwardly therefrom and at least partially around the wound wire for containing the wound wire and restraining an innermost spire thereof; and guiding means connected to the body for guiding the wire extending from the innermost spire as a free end of the spire is being pulled.

Other aspects and advantages of the present invention will be apparent from the following specification and the accompanying drawings which are for the purpose of illustration only.

DESCRIPTION OF PREFERRED EMBODIMENTS OF THE INVENTION

Figure 1:
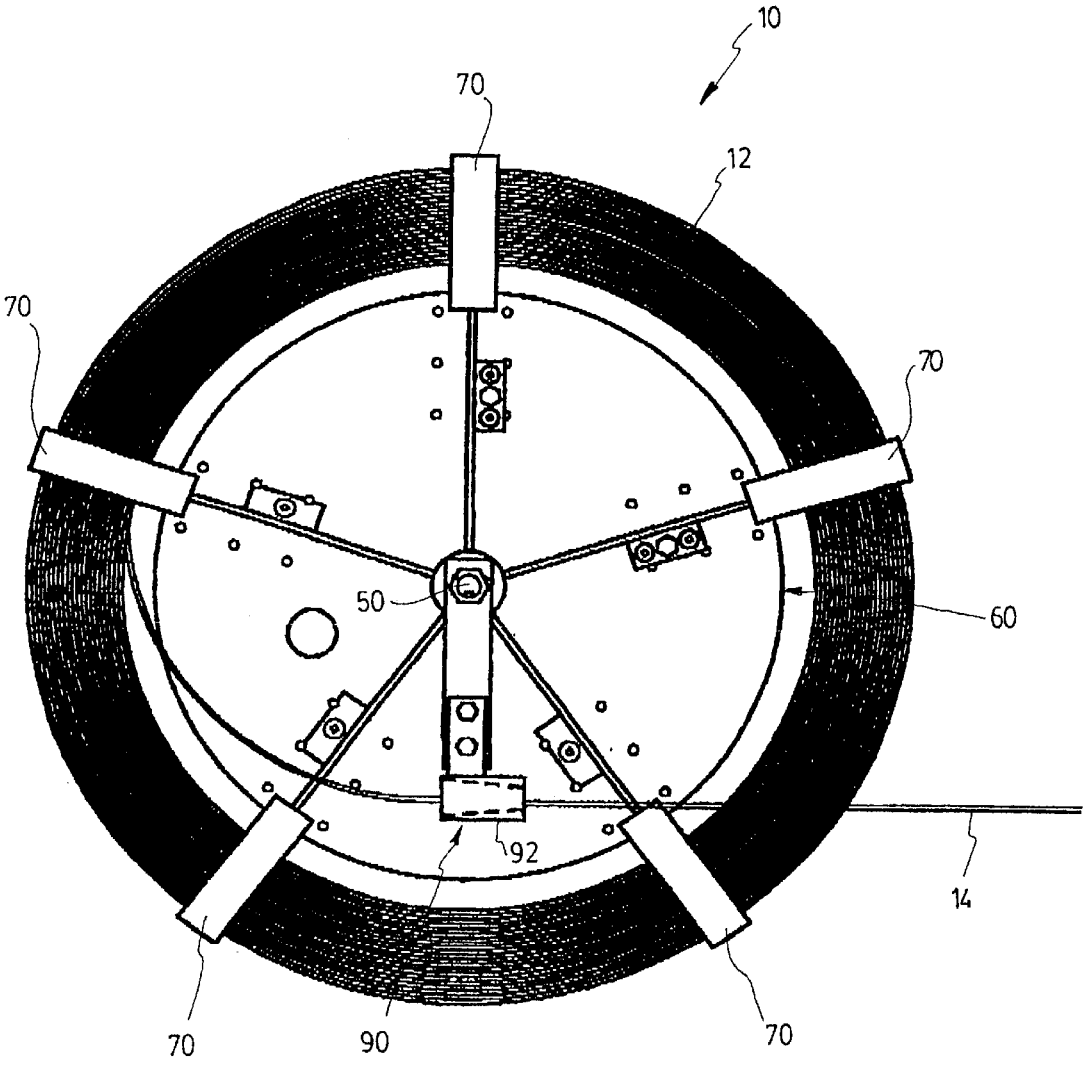
FIG. 1 is a front view from of a device for a wound wire according to a first aspect of the present invention in an operative position with a coil of a wound wire.

Referring to FIG. 1, there is shown a device 10 according to a first aspect of the present invention in an operative position with a coil of a wound wire 12 which is made of spires of a relatively stiff wire 14. A plurality of arms 70 contain the coil 12 inside the device 10 as the outer periphery of the coil 12 resiliently abut against the arms 70. The wound wire 12 is adapted to be unwound from an innermost spire and guiding means 90 guides the wire 14 as it is unwound.

Now referring to FIGS. 2 to 8, there is shown in greater details the various parts of a device 10 for a wound wire 12 according to the first aspect of the invention. The device 10 comprises a shaft 50, a hub 60 rotatively mounted around the shaft 50 and guiding means 90 connected to the shaft for guiding an innermost spire of the wound wired as a free end of the spire is being pulled.

Figure 6:
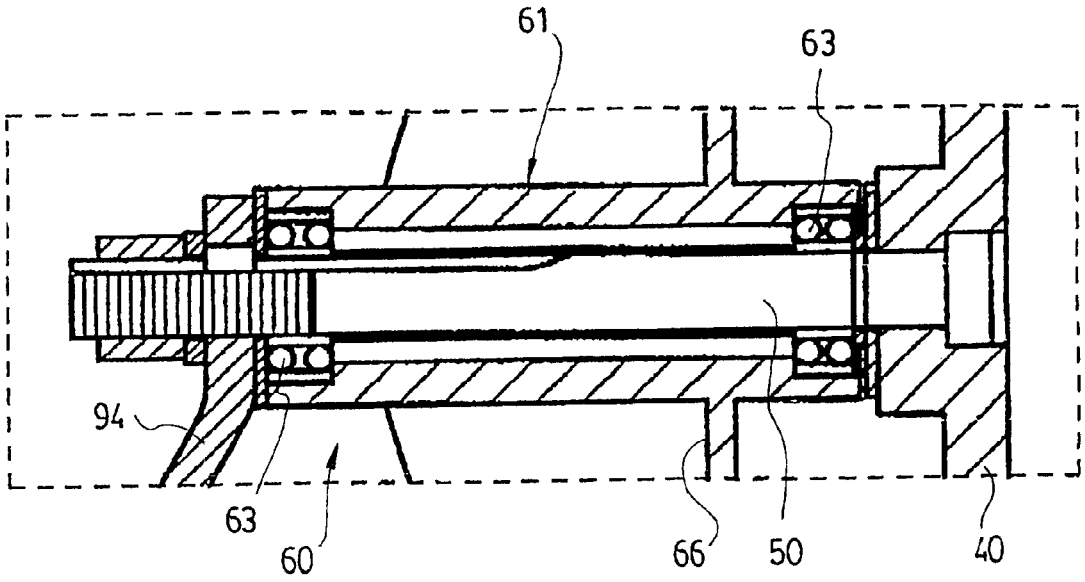
FIG. 6 is a cross-section, 3:1 enlarged view of another detail of the device shown in FIG. 4.

The hub 60 comprises a plurality of arms 70 extending radially outwardly therefrom and at least partially around the wound wire for containing the wound wire and restraining an innermost spire thereof. As best shown in FIG. 6, the hub 60 comprises a hollow central core 61 into which is preferably found two bearings 63 for a smooth rotation of the hub 60 around the shaft 50.

Figure 2:
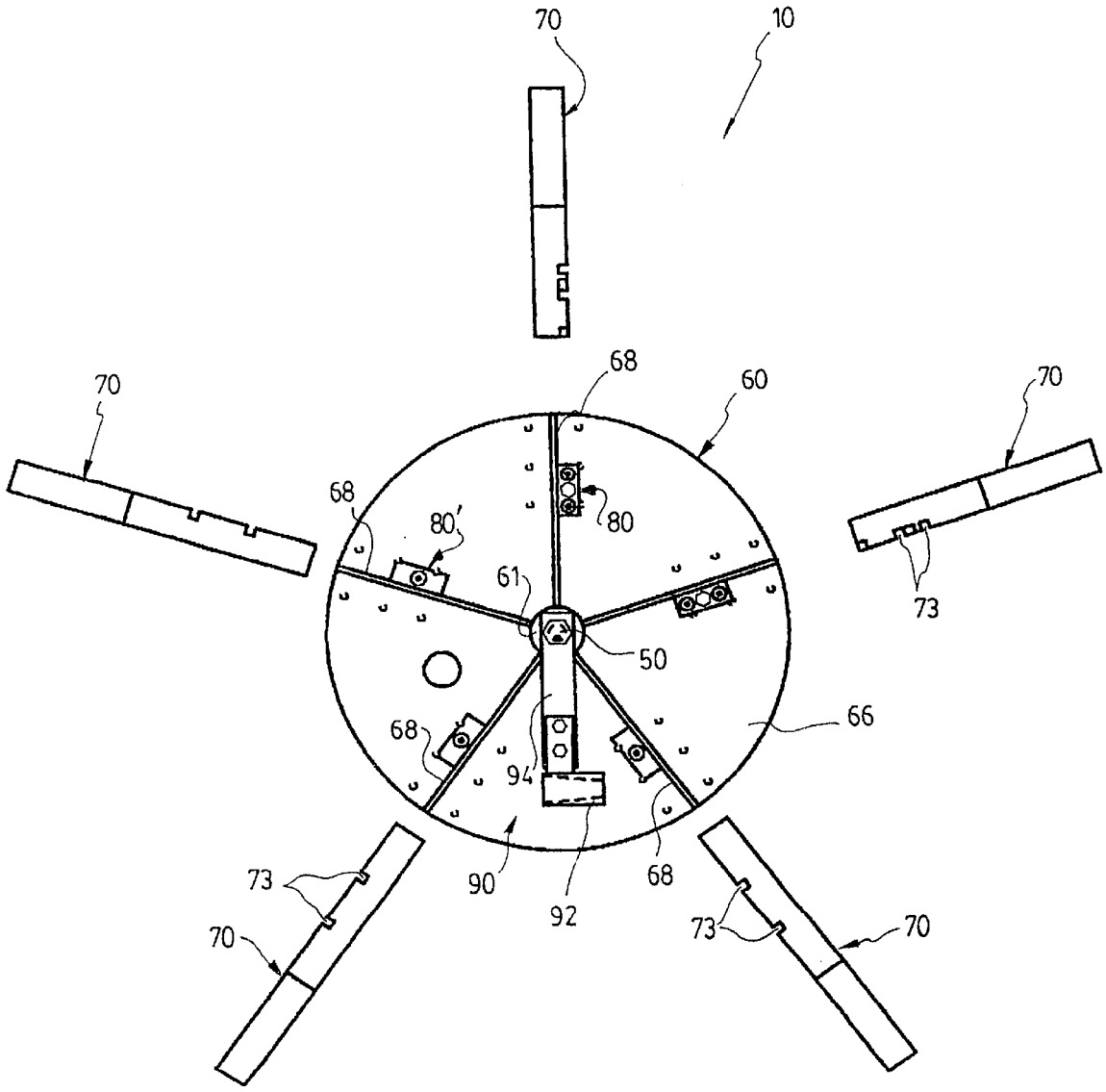
FIG. 2 is a front exploded view of the device shown in FIG. 1.
Figure 4:
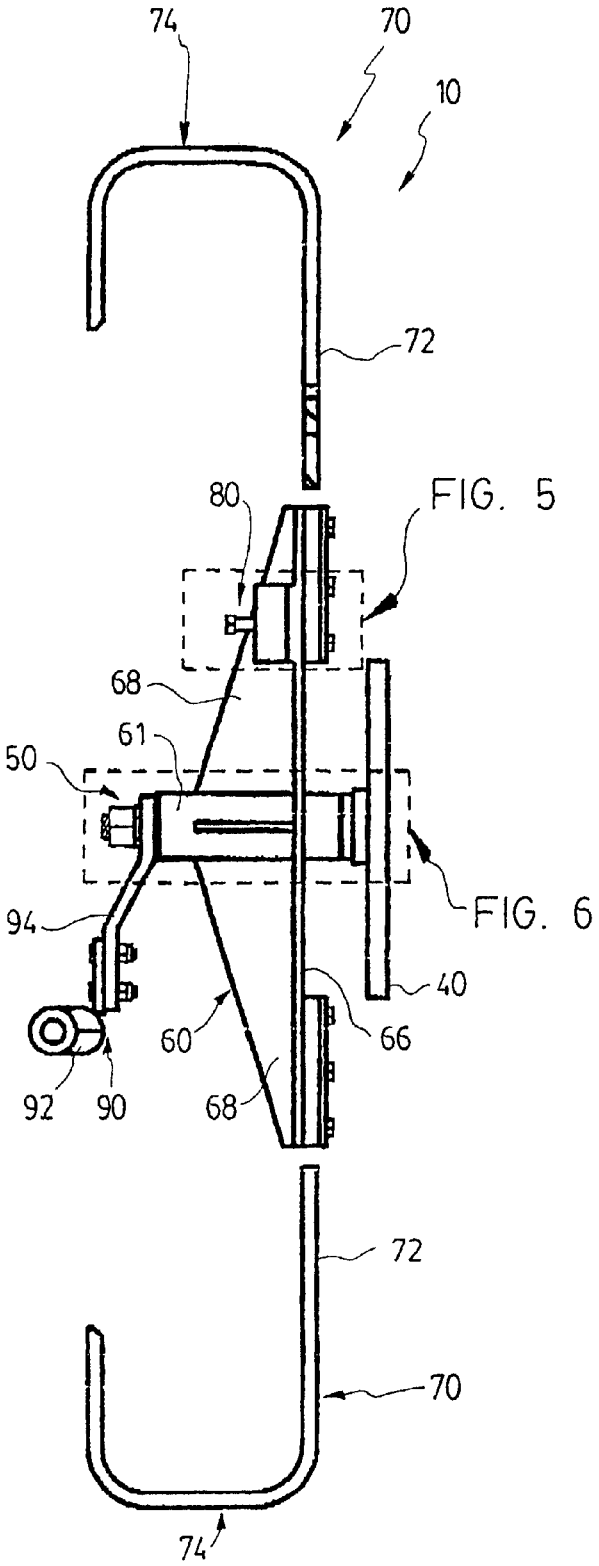
FIG. 4 is a side elevational view of the device shown in FIGS. 2 and 3.

According to a preferred embodiment, a circular disk 66 extends radially from the central core 61 (see FIGS. 2 and 4). A plurality of solidifying ribs 68 extend radially from the central core 61 for solidifying the disk 66 and rigidly connecting the disk to the central core. The disk 66 also helps to restrain the coil inside the device 10 in cooperation with the arms 70 as it will be explained hereinafter. Others embodiments devoid of a disk 66 and/or of ribs 68 are conceivable depending on the rigidity the material that is used and the user's need. Such embodiments are considered to be within the scope of the present invention.

The arms 70 are distributed around the central core 61 and they extend radially outwardly therefrom and at least partially around the wound wire. In the preferred embodiment illustrated herein, the arms 70 have a first portion 72 connected to the central core 61 through the intermediary of the circular disk 66. As shown in FIG. 4, each arm 70 is preferably terminated with a U-shaped end 74 for containing the wound wire and restraining an innermost spire thereof. Others type of arms performing the same functions are also conceivable according to the invention.

Figure 5:
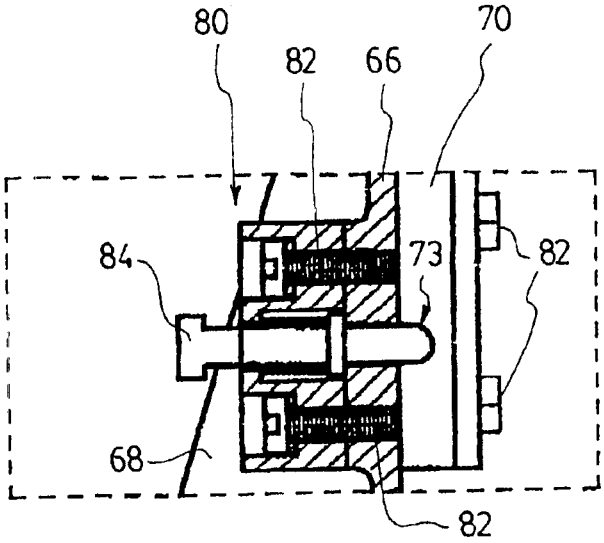
FIG. 5 is a cross-section, 3:1 enlarged view of a detail of the device shown in FIG. 4.
Figure 8:
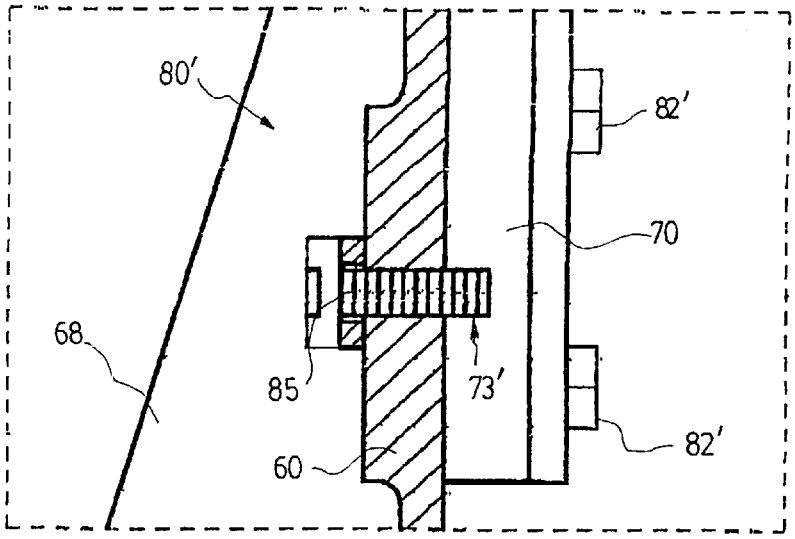
FIG. 8 is a cross-section, 3:1 enlarged view of a detail of the central portion of the device shown in FIG. 7.

As shown in FIGS. 2, 5 and 8, the device 10 further preferably comprises connecting means 80, 80' for releasable connecting the arms 70 to the circular disk 660 and for varying their length. FIG. 5 and FIG. 8 show two preferred types of connecting means 80, 80'. The connecting means 80 illustrated in FIG. 5 is rigidly connected to the circular disk with screws 82 and comprises a spring loaded pin 84 which traverse the disk 66 and extends and abut into the locking notch 73 of the arms 70. The arm 70 may thus be removed by simply pulling the pin 84 and pulling out the arm 70. The connecting means 80' illustrated in FIG. 8 is also rigidly connected to the circular disk 66 with screws 82' and comprises a bolt 85 which traverse the disk 66 and extends up into the locking notch 73' of the arm 70 in order to rigidly connect the same. Removal of the arm 70 is thus more complicated with the later connecting means 80' since tools are needed to unscrew the bolts 85.

As can be appreciated, the device 10 illustrated in the figures comprises five harms. Indeed, the Applicant has found that five arms are sufficient to efficiently and safely restrain the radial urge of the coil 12 to unwind and also restrain the innermost spire 14 of the coil 12 into the device 10. Accordingly, there is no need to provide the device 10 with a circular shield plate as described in CA 2,042,524 which is incorporated herein by reference. The normal function of such plate is to contain the wound wire inside the device and also protect the person pulling on the coil as it is being unwounded. However, such a plate (not illustrated) may be added to the device of the present invention according to the specific needs of a user.

Further to the previously listed elements, the device 10 comprises guiding means 90 connected to the shaft 50, as it is best shown in FIGS. 1, 2, 4 and 7. The guiding means 90 have for function to guide the wire 14 when a free end thereof is being pulled out during unwinding and to prevent the retraction of the wire 14 when released by a user.

Figure 7:
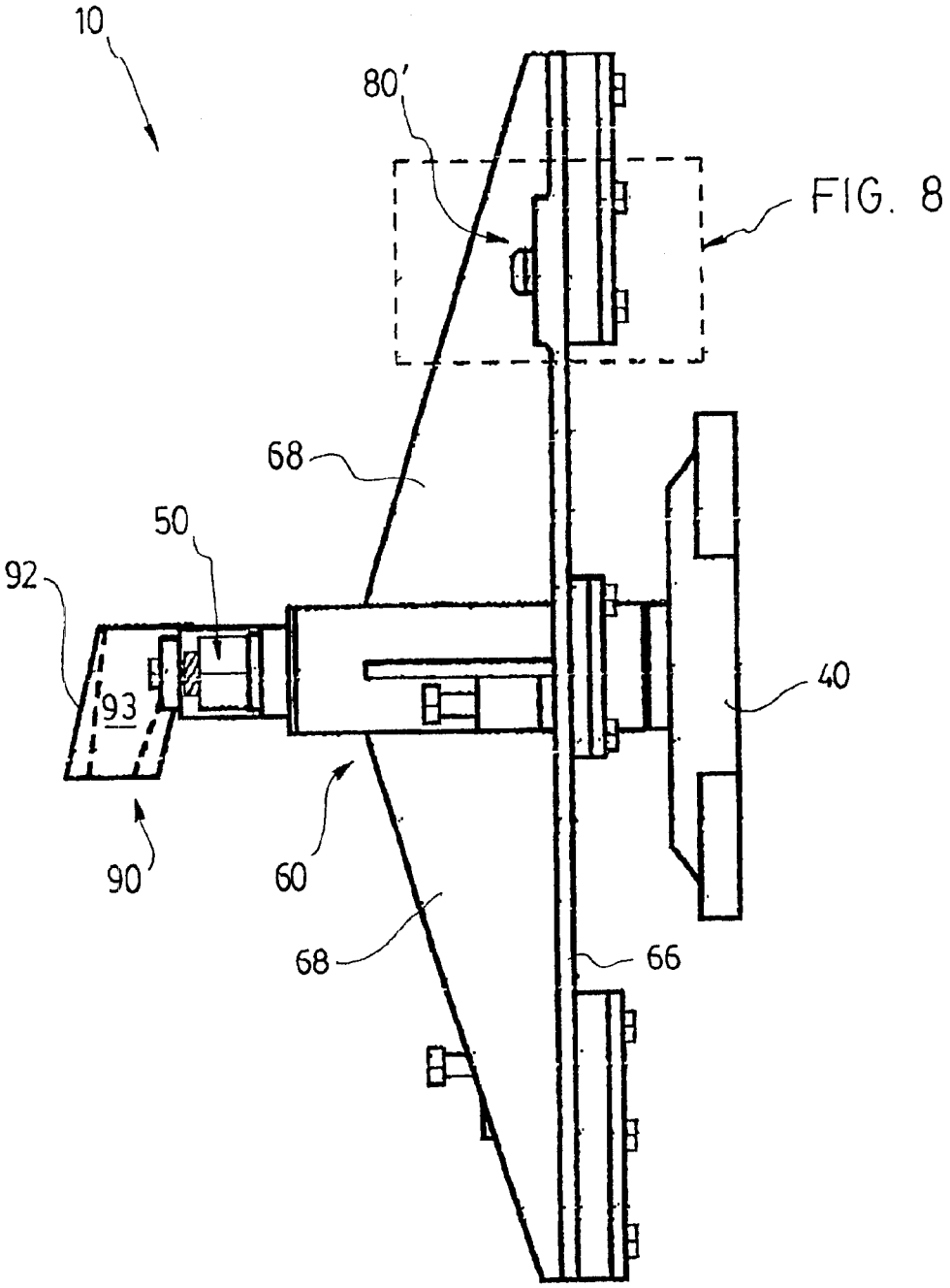
FIG. 7 is a top view of a central portion of the device shown in FIGS. 2, 3 and 4.

As best shown in FIG. 7, the guiding means 90 comprises a body 92 provided with a conical bore 93 having an inlet and an outlet that is smaller than the inlet (see dotted lines of the body 92 in FIG. 7). More preferably, the outlet has an internal diameter slightly larger than that of the wire so that the cylinder frictionally engages and holds the wire when it is released. Applicant's experience has shown that a body 92 provided with such a conical bore 93 is best adapted to guide the wire being pulled during unwinding without blocking it, and also to frictionally engage and hold the wire when it is released. As in can be understood by a person skilled in the art, the device 10 of the invention is also better functional for unwinding the wound wire when the body 92 is positioned as to be located slightly outside a vertical plan define by the wound wire 12 (shown in FIG. 1) with a slight angle horizontal angle, preferably from about 15° to 45°, with the plane (see FIGS. 4 and 7). Preferably, a plate 94 rigidly connects the body 92 to the shaft 50.

Figure 3:
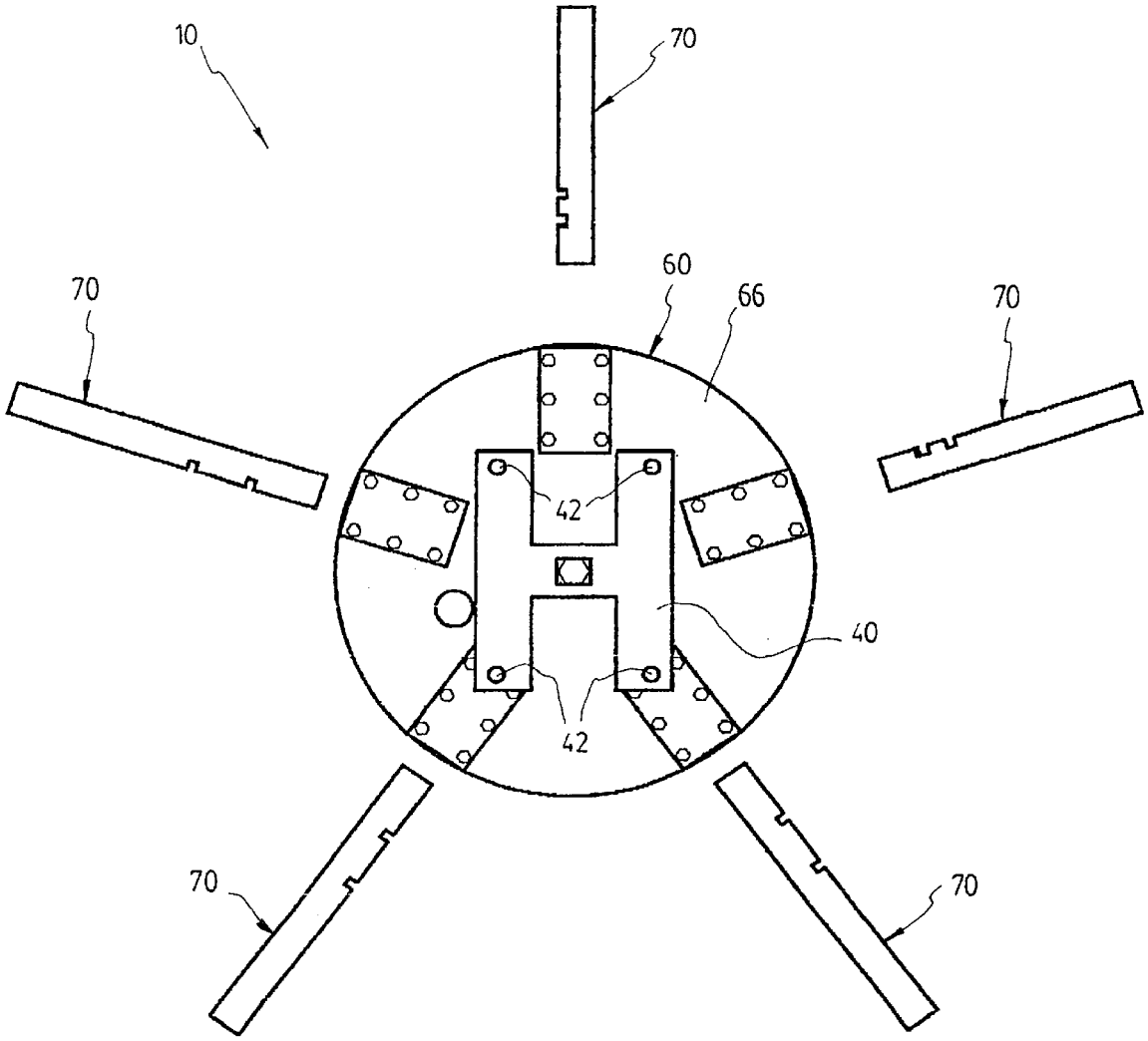
FIG. 3 is a back exploded view of the device shown in FIG. 2.
Figure 9:
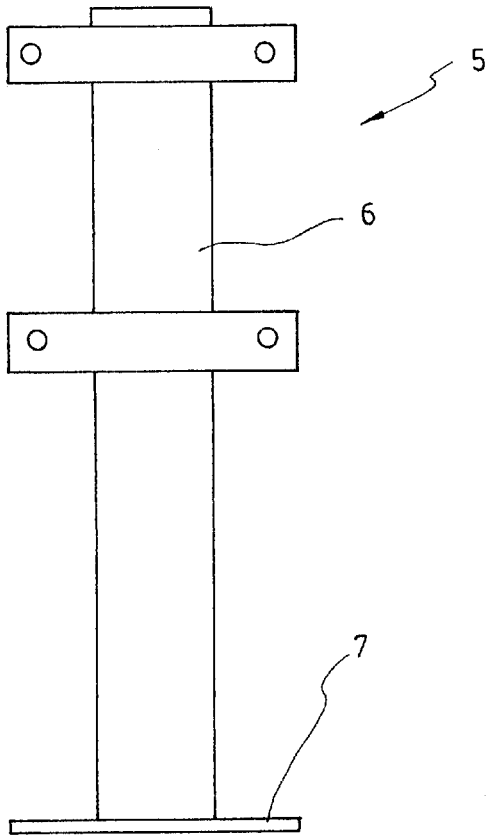
FIG. 9 is a side elevational view of a stand for mounting a device according to the present invention.

In the illustrated embodiments, the device 10 for a wound wire according to the invention further comprise mounting means 40 connected to the shaft 50. The mounting means 40 are preferable since they allow to easily mount the device 10 to a structure such as a cart, a truck wall, a vehicle etc. for the transportation of the device and/or for the unwinding of the wire. As shown in FIG. 3, the mounting means 40 preferably comprise a H-shaped plate with a plurality of holes 42 to ease the fastening of the H-shaped plate to the chosen structure. The mounting means 40 may further comprise a stand for mounting the device 10 onto the floor of a vehicle. An example of a suitable stand 5 with a support 6 mounted on a base 7 shown in FIG. 9.

According to the first aspect of the invention the shaft 50 as an end which is fixed to the mounting means 40 so as to not rotate when the mounting means 40 is fixed to a structure. However, as it will be explained hereinafter, in an other aspect of the invention, the shaft and the mounting means can be rotatively connected together. Although not illustrated, the shaft could also be adapted so as to swivel (vertically and/or horizontally) with respect to the mounting means 40.

Figure 10:
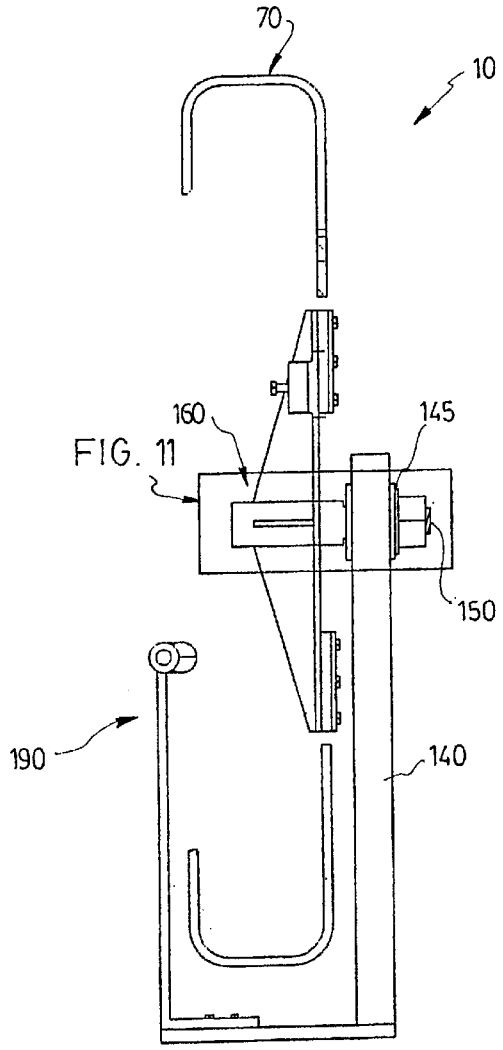
FIG. 10 is a side elevational view of a device for a wound wire according to another aspect of the present invention.
Figure 11:
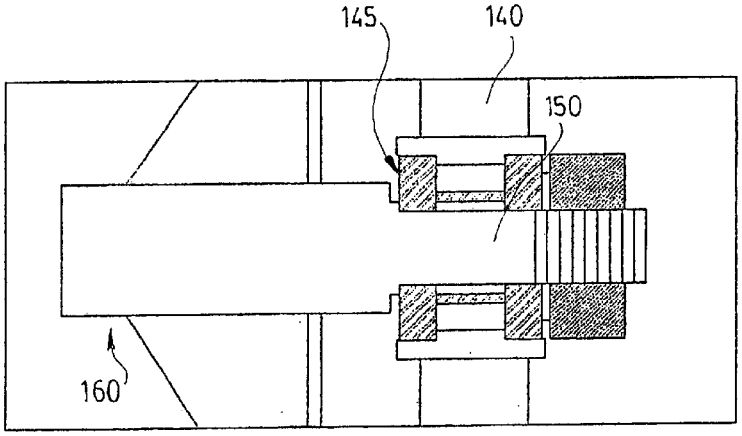
FIG. 11 is a cross-section, 3:1 enlarged view of a detail of the device shown in FIG. 10.

As shown in FIGS. 10 and 11, according to another aspect of the invention, the device 10 for a wound wire comprises a shaft 150, a body 140 rotatively mounted on the shaft 150 preferably by means of a bearing 145 or the like, a hub 160 mounted around the shaft and guiding means 190 connected to the body 140. According to this aspect of the invention, it is not necessary (although conceivable) that the hub 160 being rotatively mounted around the shaft 150 since the shaft rotates. The guiding means 190 for guiding the wire as innermost spire thereof is being pulled are also connected to the body 140 (and not to the shaft 150) for not rotating with the shaft. A person skilled in the are will understand that most of the others characteristics of the device 10 according to the first aspect of the invention described hereinbefore and shown in FIGS. 1 to 8 are also applicable to the device according to the second aspect of the invention.

The various parts of the device 10 described hereinbefore and shown in FIGS. 1 to 11 may made of a material selected from the group consisting of steel, stainless steel, and aluminum. However, most of the parts are preferably made of aluminum and the like as to give a device as light as possible. It is clear for a person skilled in the art that the shaft 50, 150 must be sufficiently solid to support the wound wire 12, and it is therefore preferable that the shaft be made of steel, more preferably of steel grade #5.

While preferred embodiments of the invention has been described, it will be understood that the present invention is capable of further modification, and this application is intended to cover any variations, uses, or adaptation of the invention, following in general the principles of the invention and including such departures from the present disclosure as to come within knowledge or customary practice in the art to which the invention pertains, and as may be applied to the essential features hereinbefore set forth and falling within the scope of the invention.

What is claimed is:

1. A device for a wound wire that is relatively stiff, comprising:

a shaft;

a hub rotatively mounted around the shaft, the hub comprising a central core and a plurality of arms extending radially outwardly therefrom and at least partially around the wound wire for containing the wound wire and restraining an innermost spire thereof;

guiding means connected to the shaft for guiding the wire extending from the innermost spire as a free end of the spire is being pulled; and wherein the guiding means comprises a body provided with a conical bore having an inlet and an outlet that is smaller than said inlet, the outlet having an internal diameter slightly larger than that of the wire so that the body frictionally engages and holds the wire when released.

2. The device of claim 1, wherein said plurality of arms comprises at least five arms.

3. The device of claim 1, further comprising connecting means for releasably connecting at least some of the arms to the hub.

4. The device of claim 1, wherein each of the arms are terminated with a U-shaped end.

5. The device of claim 1, further comprising mounting means connected to the shaft for fixing the device to a structure.

6. The device of claim 1, wherein the body is rigidly connected to the shaft, and wherein the body is positioned as to be located slightly outside a vertical plane defined by the wound wire with an horizontal angle from about 15° to 45° with said plane.

7. The device of claim 1, wherein:

the shaft is made of steel or of stainless steel; and the mounting means, the hub, the arms and the guiding means are made at least partially of aluminum.

8. A device for a wound wire that is relatively stiff, comprising:

a shaft;

a hub rotatively mounted around the shaft, the hub comprising a central core and a circular disk extending radially outwardly from the central core, and a plurality of arms connected to the circular disk and extending radially outwardly therefrom and at least partially around the wound wire for containing the wound wire and restraining an innermost spire thereof; and guiding means connected to the shaft for guiding the wire extending from the innermost spire as a free end of the spire is being pulled;

wherein the circular disk comprises a plurality of solidifying ribs extending radially from the central core for solidifying the disk and rigidly connecting the disk to the central core.

9. A device for a wound wire that is relatively stiff, comprising:

a shaft;

mounting means rigidly connected to a first end of the shaft;

a hub rotatively mounted around the shaft and comprising:

a central core;

a circular disk extending radially outwardly from the central core;

a plurality of solidifying ribs extending radially from the central core for solidifying the disk and for rigidly connecting the disk to the central core; and at least five arms connected around the circular disk and extending radially outwardly from the central core, each of the arms being terminated with a U-shaped end for containing the wound wire and restraining an innermost spire thereof; and guiding means rigidly connected to a second end of the shaft for guiding the wire extending from the innermost spire of the wire as a free end thereof is being pulled, the guiding means comprising a body provided with a conical bore having an inlet and an outlet that is smaller than said inlet, the outlet having an internal diameter slightly larger than that of the wire so that the body frictionally engages and holds the wire when it is released.

10. A device for a wound wire that is relatively stiff, comprising:

a shaft;

a body rotatively mounted on the shaft;

a hub mounted around the shaft, the hub comprising a central core and a plurality of arms extending radially outward therefrom and at least partially around the wound wire for containing the wound wire and restraining an innermost spire thereof; and guiding means connected to the body for guiding the wire extending from the innermost spire as a free end of the spire is being pulled;

wherein said plurality of arms comprises at least five arms respectively terminated with U-shaped ends.

11. The device of claim 10, further comprising connecting means for releasably connecting at least some of the arms to the hub.

12. The device of claim 10, wherein the body comprises fixing means for releasably fixing the device to a structure.

13. A device for a wound wire that is relatively stiff, comprising:

a shaft;

a first body rotatively mounted on the shaft;

a hub mounted around the shaft, the hub comprising a central core and a plurality of arms extending radially outward therefrom and at least partially around the wound wire for containing the wound wire and restraining an innermost spire thereof; and guiding means connected to the first body for guiding the wire extending from the innermost spire as a free end of the spire is being pulled; wherein the guiding means comprises a second body provided with a conical bore having an inlet and an outlet that is smaller than said inlet, the outlet having an internal diameter slightly larger than that of the wire so that the second body frictionally engages and holds the wire when it is released.

14. The device of claim 13, wherein the second body is rigidly connected to the guiding means, and wherein the second body is positioned as to be located slightly outside a vertical plane defined by the wound wire with an horizontal angle from about 15° to 45° with said plane.

15. A device for a wound wire that is relatively stiff, comprising:

a shaft;

a body rotatively mounted on the shaft;

a hub mounted around the shaft, the hub comprising a central core and a plurality of arms extending radially outwardly therefrom and at least partially around the wound wire for containing the wound wire and restraining an innermost spire thereof; and guiding means connected to the body for guiding the wire extending from the innermost spire as a free end of the spire is being pulled;

wherein:

the hub comprises a circular disk extending radially outwardly from the central core;

the circular disk comprises a plurality of solidifying ribs extending radially from the central core for solidifying the disk and rigidly connecting the disk to the central core; and the arms are connected to the circular disk.

* * * * *